US008632366B2

(12) United States Patent
Sano et al.

(10) Patent No.: US 8,632,366 B2
(45) Date of Patent: Jan. 21, 2014

(54) SOCKET WITH INTEGRATED DAMPING RESISTOR

(75) Inventors: Hideki Sano, Gotemba (JP); Hiroyuki Abe, Gotemba (JP); Yasushi Ishikawa, Gotemba (JP); Toyokazu Ezura, Kawasaki (JP); Yasuhisa Tsukada, Fujisawa (JP)

(73) Assignee: Sensata Technologies Massachusetts, Inc., Attleboro, MA (US)

( * ) Notice: Subject to any disclaimer, the term of this patent is extended or adjusted under 35 U.S.C. 154(b) by 0 days.

(21) Appl. No.: 13/435,895

(22) Filed: Mar. 30, 2012

(65) Prior Publication Data

US 2012/0252233 A1 Oct. 4, 2012

(30) Foreign Application Priority Data

Mar. 31, 2011 (JP) ..... 2011-078596

(51) Int. Cl.
*H01R 24/00* (2011.01)

(52) U.S. Cl.
USPC ..... 439/637; 439/157

(58) Field of Classification Search
USPC ..... 439/152–160, 328, 637
See application file for complete search history.

(56) References Cited

U.S. PATENT DOCUMENTS

| | | | | | |
|---|---|---|---|---|---|
| 4,080,027 | A * | 3/1978 | Benasutti | 439/260 |
| 5,308,249 | A * | 5/1994 | Renn et al. | 439/62 |
| 5,443,394 | A * | 8/1995 | Billman et al. | 439/157 |
| 5,676,559 | A * | 10/1997 | Laub et al. | 439/260 |
| 5,800,186 | A * | 9/1998 | Ramirez et al. | 439/74 |
| 7,288,005 | B2 * | 10/2007 | Nagahashi | 439/637 |
| 7,651,366 | B2 * | 1/2010 | Ringler et al. | 439/513 |
| 8,385,080 | B2 * | 2/2013 | Kim et al. | 361/783 |

* cited by examiner

*Primary Examiner* — Thanh Tam Le
(74) *Attorney, Agent, or Firm* — Chapin IP Law, LLC

(57) ABSTRACT

This invention provides a socket for a circuit board that adds function of electrical resistive element to a contact. A socket includes a socket body extending at a longitudinal direction; and a plurality of contacts disposed in two lines along the longitudinal direction of the socket body. When a memory module is connected to the socket body, terminals formed on opposite surfaces of the memory module are electrically and elastically connected by the contacts. The contact includes a contact portion which contacts the terminal, a bent portion for generating an elastic force, and a base portion. The contact is made of a conductive metal having elastic properties, and the contact used for carrying signal is provided with a resistor of an electrical resistive material that is different from the conductive metal. The resistor is connected in a current path between the base portion and the terminal of the memory module.

13 Claims, 14 Drawing Sheets

SOCKET WITH INTEGRATED DAMPING RESISTOR

CROSS REFERENCE TO RELATED APPLICATIONS

The present application claims priority to Japanese Patent Application No. 2011-078596, filed 31 Mar. 2011, which is incorporated herein by reference in its entirety.

FIELD OF THE INVENTION

The present invention relates to a socket installed on a circuit board, more particularly, to a memory module with a plurality of memory chips installed in a socket and to a memory module system using the socket.

RELATED ART

A memory module having mass storage is configured to mount a plurality of semiconductor memory chips, such as dynamic random access memory (DRAM), statistic random access memory or flash memory, at single side of both sides of the circuit board. Such memory module is installed on a socket and the socket is installed on a motherboard to make up a memory module system. Japanese patent publication 2002-298998, 2001-110532 and 2000-173699 discloses a socket installing the memory module.

FIGS. 1A-1C show a conventional socket for a memory module and FIG. 1D is a plan view of a motherboard mounting a socket. The socket 10 includes a socket body 12 of an electrically insulated material and elongated at a longitudinal direction, a plurality of contacts 14 disposed in two lines along with the longitudinal direction of the socket body 12, a plurality of posts 16 extending from the socket body 12 downward for attaching the socket body 12 with the motherboard 20, and manipulating levers 18 rotatably attached with the opposite sides of the socket body 12.

The socket body 12 is formed with a groove 12A along with the longitudinal direction to allow inserting an edge of approximately rectangular-shaped memory module thereto. An opening 12C for receiving the contact is formed adjacent to the groove 12A through a sidewall 12B (See, for example, FIG. 6A and FIG. 6B.) A plurality of contacts 14 is disposed in two lines across the groove 12A. Each contact portion of the contact 14 is designed to press the memory module in opposite. One contact has a base portion that is folded outward and the other contact has a base portion that is straight, and both are placed alternately along with the longitudinal direction, so that each base portion is projected from the bottom of the socket body 12. Therefore, as shown in FIG. 1D, the motherboard 20 is formed with four lines of through holes 20A whose pitch in the longitudinal direction is offset by ½, The base portions of the contacts 14 are inserted into the through holes 20A respectively and soldered thereto. The posts 16 are formed at the opposite sides and at the lower center of the socket body 12. and they are inserted into holes 20B of the motherboard 20 and fixed thereto by soldering and the like.

A pair of manipulating levers 18 is rotatably attached with the socket body 12. When the memory module is installed in the socket body 12, the manipulating levers 18 are at an external opened position. When the memory module is inserted into the groove 12A, the manipulating levers 18 press the memory module toward the socket body 12 by rotating the manipulating levers 18 toward the closed direction. In case of removing the memory module, by rotating toward the opened direction, the manipulating levers 18 provide the forces in a direction so that the memory module is separated from the socket body 12.

FIGS. 2A and 2B illustrate an interface of the conventional memory module system. As shown in FIG. 2A, the socket 10 with the memory module 30 is installed on the motherboard 20. The memory module 30 includes a sub board 32 on which conductive traces 36 are formed and a plurality of memory chips 34 are mounted on one side or both sides of the sub board 32. A plurality of terminals is formed at the end of the sub board 32 and their terminals are electrically connected to the contact portions of the contacts 14 respectively. In addition, the conductive traces are formed on the surface of the motherboard 20 and a damping resistor 24 or electronic device 26 is electrically connected to a signal line 22 of the conductive trace. Each contact 14 projecting from the bottom of the socket 10 is electrically connected to the damping resistor 24 and the electronic device 26 through the signal line 22.

FIG. 2B shows another example of an interface of the conventional memory module system. In this case, in addition to the damping resistor 24, another damping resistor 24A is also contacts a signal line 36 of the memory module 30A. Also, the damping resistor 24A may be connected to the signal line 36 of the memory module 30 instead of the damping resistor on the motherboard 20.

FIG. 3 shows a configuration of an electrical circuit interface of the conventional memory module system. A memory controller 50 fed by a power supply Vcc is electrically connected to the memory module 60-1, 60-2 through the signal lines 52 respectively. Each resistor R2, R3 is connected to branches of stub of the signal lines 52 in serial and each resistor R1, R4 contacts the signal lines 52 respectively. The resistor R1 to R4 decreases or suppresses noise and/or ringing of the carried signals on the signal line 52. The resistance of damping resistor R1 to R4 depends on the characteristics of the signal line such as voltage and frequency of the carried signal, a few ohms to a few dozen ohm of resistance is employed.

SUMMARY OF THE INVENTION

In the conventional memory module systems, the damping resistor 24, 24A has to be formed on the motherboard 20 or the memory board 32, therefore the space for the damping resistor is required on the mother board 20 or the memory board 32. Consequently, there were problems in facilitating to downsize and thin the memory module system. Furthermore, as the number of sockets and/or memory modules mounted on the motherboard 20 is increased, more damping resistors are required for the signal lines, which causes the complication of board design in the memory module system.

The present invention intends to provide an improved socket for a circuit board that solves the above-mentioned conventional problems and adds function of electrical resistive element to a contact.

A socket in accordance with the present invention includes a socket body extending at a longitudinal direction, and a plurality of contacts disposed in two lines along with the longitudinal direction of the socket body. When a circuit board and the socket are connected between the two lines of the contacts along with the longitudinal direction of the socket body, terminals formed at least one of opposite surfaces of the circuit board are electrically and elastically connected by the contacts. Each contact includes a contact portion for contacting with the terminal, an elastic portion extended from the contact portion and for generating an elastic force, and an external terminal portion connected to the elastic portion, the contact portion, the elastic portion and the external terminal portion are made of a conductive metal with elastic properties. The contact used for carrying signal is provided with a resistor of an electrical resistive material that is different from the conductive metal, the resistor is connected in a current path between the external terminal portion and the terminal of the circuit board.

Preferably, the resistor engages with an opening formed in the contact portion so as to be projected from the contact portion, and the contact portion is capable of electrically connecting with the terminal of the circuit board through the resistor. Preferably the resistor includes a conductor and a resistive film, and the conductor is electrically connected to the contact portion through the resistive film. Preferably the resistor includes an electrical protective film laminated on the conductive metal and an electrical resistive film. Preferably the electrical protective film and the electrical resistive film cover the contact portion and a part of the external terminal portion, the contact portion is electrically connected to the terminal of the circuit board through the electrical resistive film, the conductive metal of the external terminal portion contacts a reference potential, and the electrical resistive film of the external terminal portion is connected to a signal line. Preferably the resistor includes a resistive film covering the surface of the contact portion. Preferably one end of the resistor is supported by the socket body as a cantilever, and the resistor is connected between the contact portion and the terminals of the circuit board. Preferably the contact includes a first and second contact portions, the first contact portion has the contact portion and the elastic portion, the second contact portion has the external terminal portion, and the resistor is electrically connected between the first and second contact portions. Preferably the first contact portion is made of a conductive metal with elastic properties and the second contact portion is made of a conducive material different from that of the first contact portion. Preferably the circuit board is a memory module that includes a plurality of semiconductor memory chips mounted on its surface.

A circuit board system in accordance with the present invention includes a socket with above features, a circuit board connected to the socket and contacting each contact portion of a plurality of contacts; and another circuit board mounting the socket and contacts each external terminal portions of a plurality of contacts. Preferably another circuit board includes a main surface on which a signal line(s) and a reference potential line(s) spaced from the signal line are formed, the conductive metal of the external terminal portion is connected to the reference potential line, and the electrical resistive film of the external terminal portion is connected to the signal line. Preferably another circuit board includes through-holes and the external terminal portion is inserted into the through hole to electrically connect with the signal line.

According to the present invention, by adding the resistive function to the contact, which allows reducing the damping resistors required on the circuit board, thereby facilitating to downsize and thin the circuit board system. Furthermore, the present invention contributes to ease the design of the circuit board.

BRIEF DESCRIPTION OF THE DRAWINGS

The foregoing will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Figure 1A:
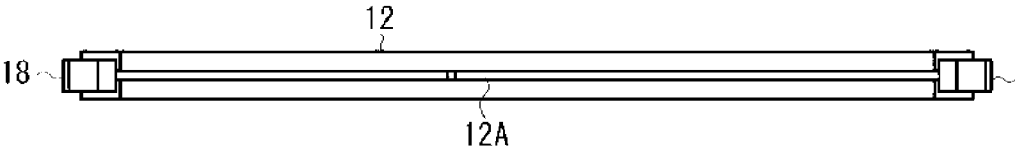
FIG. 1A (Prior Art)
FIGS. 1A-1D show schematic configuration of a conventional socket for memory module.
Figure 1C:
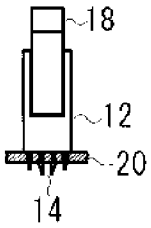
FIG. 1C (Prior Art)
Figure 1B:
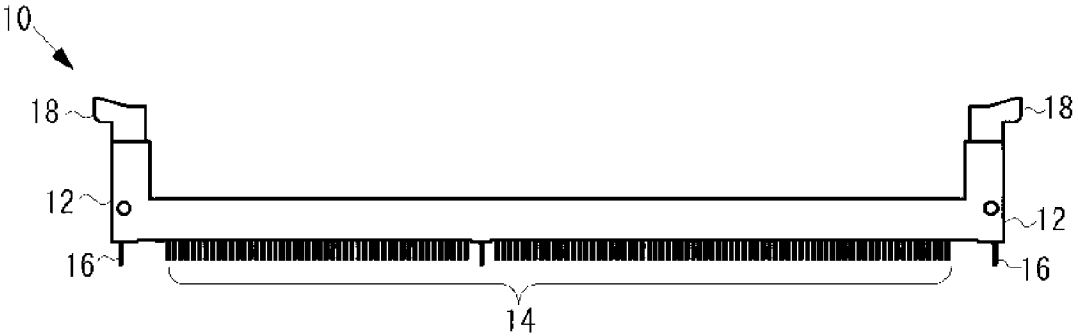
FIG. 1B (Prior Art)
Figure 1D:
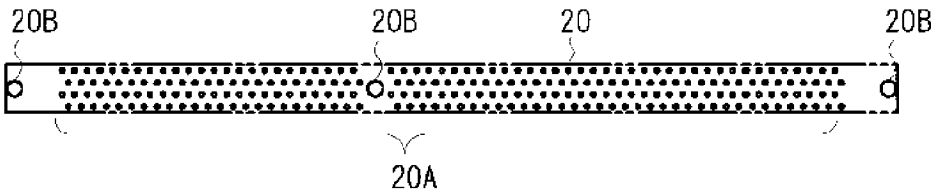
FIG. 1D (Prior Art)
Figure 2B:
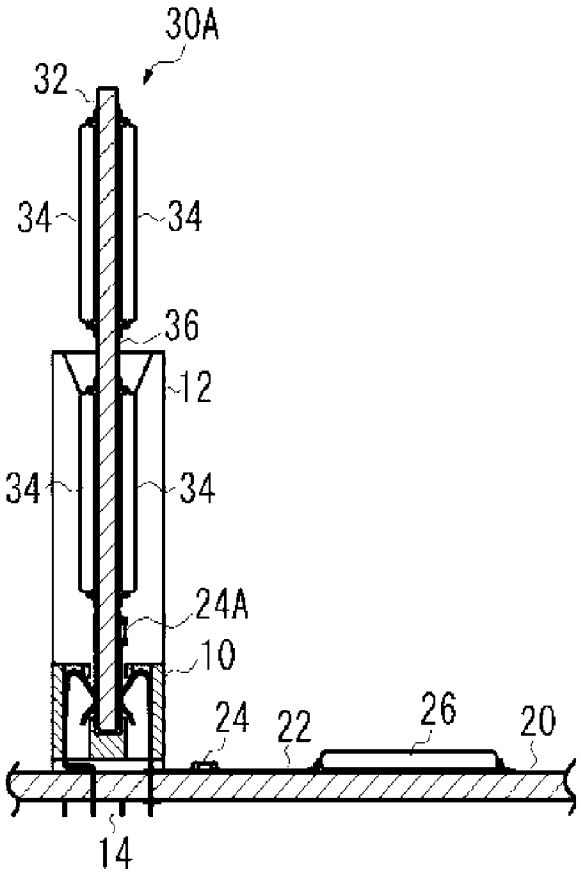
FIG. 2B (Prior Art)
FIGS. 2A and 2B show an explanation for an interface of a conventional memory module system.
Figure 2A:
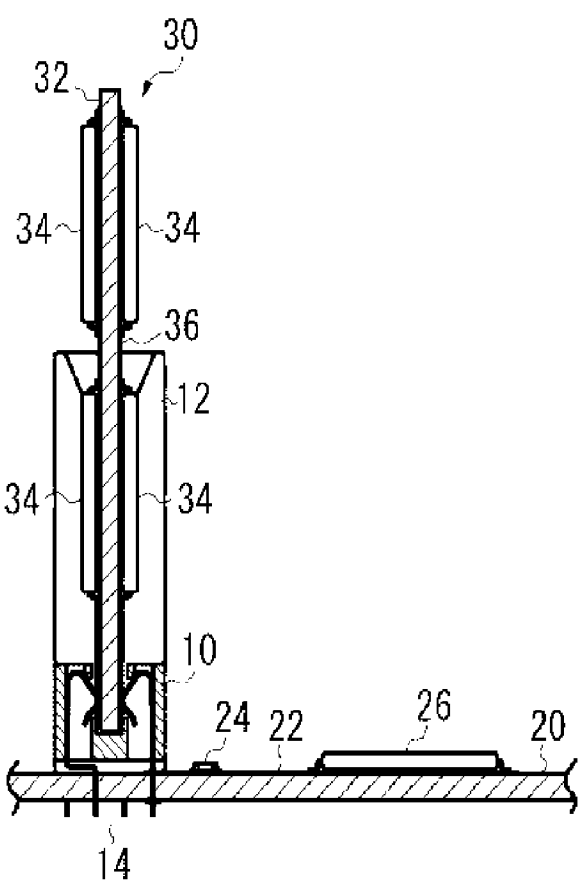
FIG. 2A (Prior Art)
Figure 3:
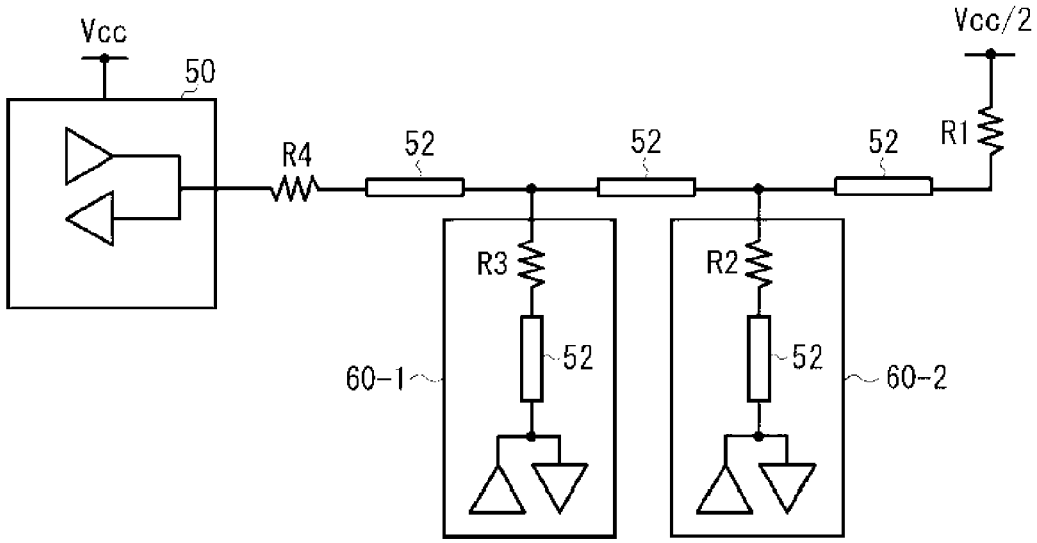
FIG. 3 (Prior Art)
FIG. 3 shows an explanation of an electrical interface of a conventional memory module system.

Disclosed herein is a socket that is installed in a circuit board that requires damping resistors to prevent noise and/or ringing of carried signal on the circuit board. The circuit board may be a module on which is mounted a plurality of semiconductor chips or memory chips, and the semiconductor chips or memory chips are electrically connected through signal lines of conductive traces formed on the surface or inside of the circuit board. A memory module system with a motherboard having a socket with a memory module is described below. It should be noted that the scale in the drawings is represented to understand the present invention easily and it does not express the actual scale of products.

Figure 4:
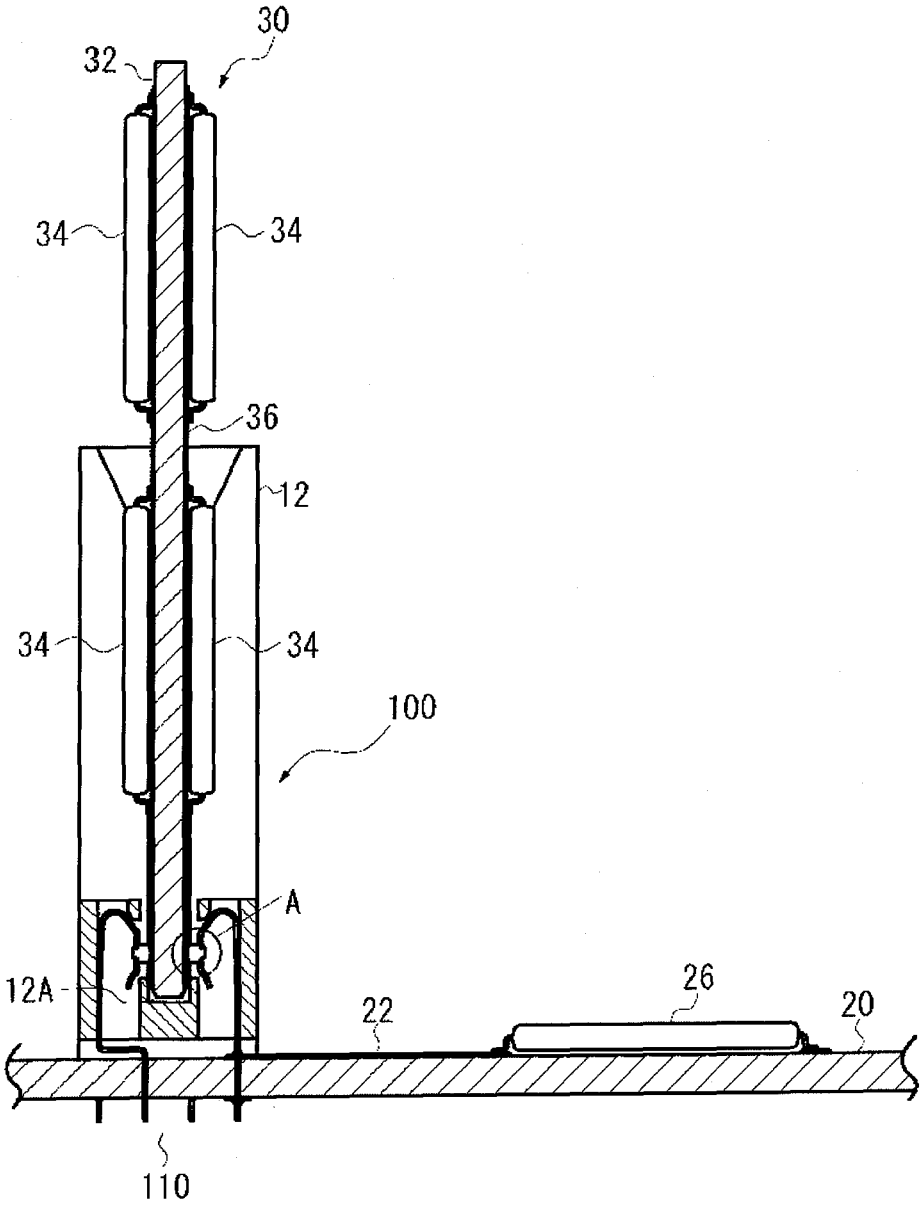
FIG. 4 is a schematic sectional view showing a memory module system in accordance with a first embodiment of the present invention.

FIG. 4 shows a configuration of a memory module system in accordance with an embodiment of the present invention. The conventional configurations as described in FIGS. 1A-1D and FIGS. 2A-2D have some elements in common and the same respective reference numbers are used and their explanation is omitted here. A socket 100 in accordance with the embodiment includes a socket body 12 elongated at a longitudinal direction and a plurality of contacts 110 fixed in the body 12. The socket 100 has substantially the same configuration as the socket in FIGS. 1A-1D and FIGS. 2A-2D except that the contact 110 has a function of electrical resistance.

Figure 5A:
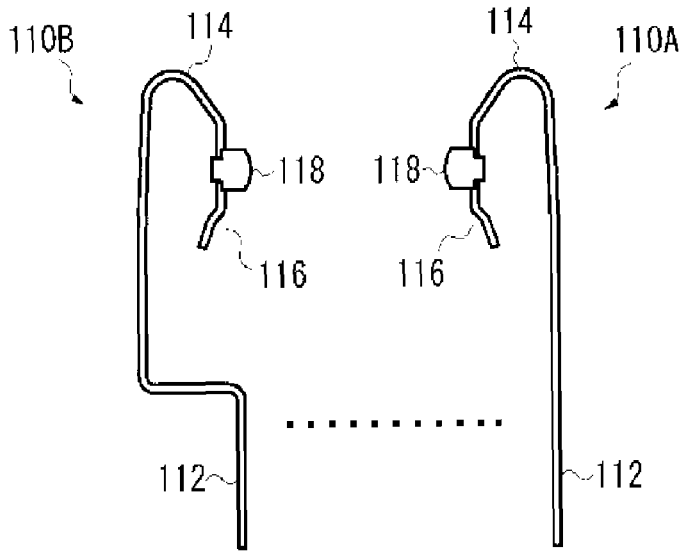
FIG. 5A is a plan view of a pair of contacts and FIG. 5B to FIG. 5D are examples of a contact having resistive function in accordance with the first embodiment of the present invention.

FIG. 5A shows a pair of contact 110A, 110B connected to the signal line 22. The pair of the contact 110A, 110B elastically presses the edge of the memory module 30 in opposite inserted into a groove 12A of the socket body 12. A plurality of terminals is formed on the one side or both sides of the memory module 30, their terminals are electrically connected to the memory chips through the signal lines of the conductive traces.

Each contact 110A, 110B includes a base portion 112, an U-shaped bent portion 114 extending from the base portion 112 and a contact portion 116 extending from the bent portion 114. The contact 110A, 110B is made by stamping a conductive metal having elasticity such as a copper or beryllium copper. The base portion 112 of the contact 110A extends straightly and is inserted into the outer through hole of the motherboard 20 shown in FIG. 1D to be used as an outer contact, while the base portion 112 of the contact 110B is bent at a right angle as a crank shape and is inserted into the inner through hole of the motherboards 20 to be used as an inner contact. As described hereinafter, in case that the socket 100 is surface-mounted on the motherboard 20, the base portions of the contact 110A, 110B are processed for conforming to the surface-mount process.

A resistor 118 functioning as electrical resistance is added to each contact portion of the contact 110A, 110B and the resistor 118 is electrically connected to the contact portion 116. The resistor 118 is made of a different material from that of the contact 110A, 110B. The resistor 118 is substituted for the damping resistor 24, 24A shown in FIG. 2A and FIG. 2B or complement the dumping resistor 24, 24A. Therefore, the value of the resistor 118 is determined in accordance with the characteristics of the signal lines of the memory module system. In other words, the resistance is selected to reduce and/or suppress noises and/or ringing of the carried signals. Although the socket 100 includes not only the contacts electrically connected to the signal lines 22 for carrying signals but also the contacts electrically connected to the power supply Vcc and ground line, the resistor 118 is added to the contacts for the signal lines 22.

The groove 12A is formed along with the longitudinal direction of the socket body 12 and a plurality of contacts 110 having pairs of contact 110A, 110B is disposed at both sides across the groove 12A. When the edge of the memory module 30 is inserted into the groove 12A of the socket body 12, each contact portion 116 is displaced outward due to the elastic deformation of the bent portion 114, so that each contact is electrically connected to the terminals formed on the one side or both sides of the memory module 30 through the resistor 118. As shown in FIG. 4, the base portion 112 of the contact 110A is projected from the socket body 12 downward and is inserted into the outer through hole of the motherboard 20 for making electrical contact with the signal line 22 by soldering. The base portion 112 of the contact 110B is inserted into the inner through hole of the motherboard 20 for making an electrical contact with the signal lines, not shown in the drawings, by soldering.

Figure 5B:
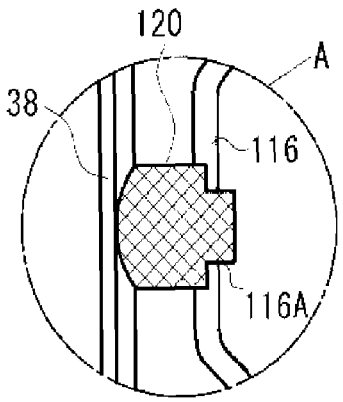
Figure 5C:
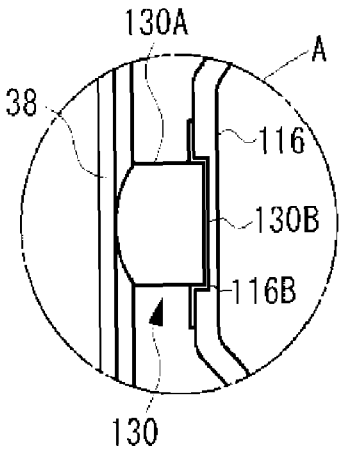
Figure 5D:
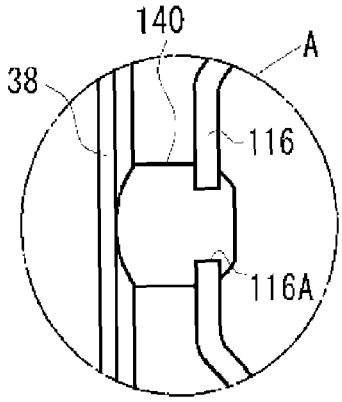

FIG. 5B to 5D show examples of contact in accordance with this embodiment and show enlarged portion A in FIG. 4. The contact shown in FIG. 5B includes the resistor 120 of a conductive ceramic material at the opening 116A of the contact portion 116 by pressing, crimping or insert molding the end of the resistor 120 therein. The conductive ceramic material is for example ZrO2-NbC. The surface of the resistor 120 may be coated with hard plating for contact. Thus, the contact portion 116 is formed with the projection as the resistor 120 and the resistor 120 is connected in the current path between the contact portion 116 and the terminal 38 of the memory module 30, which enables the resistor 120 to function as the damping resistor.

In the example of FIG. 5C, a resistor 130 includes a conductor 130A and an electrical resistive film 130B made of an electrical resistive material. The conductor 130A is, for example, made of a stainless, aluminum or copper. Preferably, the contact portion 116 is formed with a recess portion 116B and the electrical resistive film 130B with a predetermined thickness is formed on the surface of the recess portion 116B by sputtering and the like. The conductor 130A is fixed within the recess portion 116B by intrusion, crimping or insert molding and is electrically connected to the contact portion 116 through the electrical resistive film 130B. By conditioning thickness and material of the electrical resistive film 130B, the resistance needed for damping resistor can be obtained.

In the example in FIG. 5D, a resistive portion 140 is made of a conductive resin. The conductive resin may be a resin of conductive particles such as mixture of an aluminum, stainless, or carbon. The resistive portion 140 is fixed with the opening of the contact portion 116 by intrusion, crimping or insert molding and hard plating for contact may be coated on the surface of the resistive portion 140. Thus, the contact portion 116 is electrically connected to the terminal 38 through the protruding resistive portion 140.

Figure 6A:
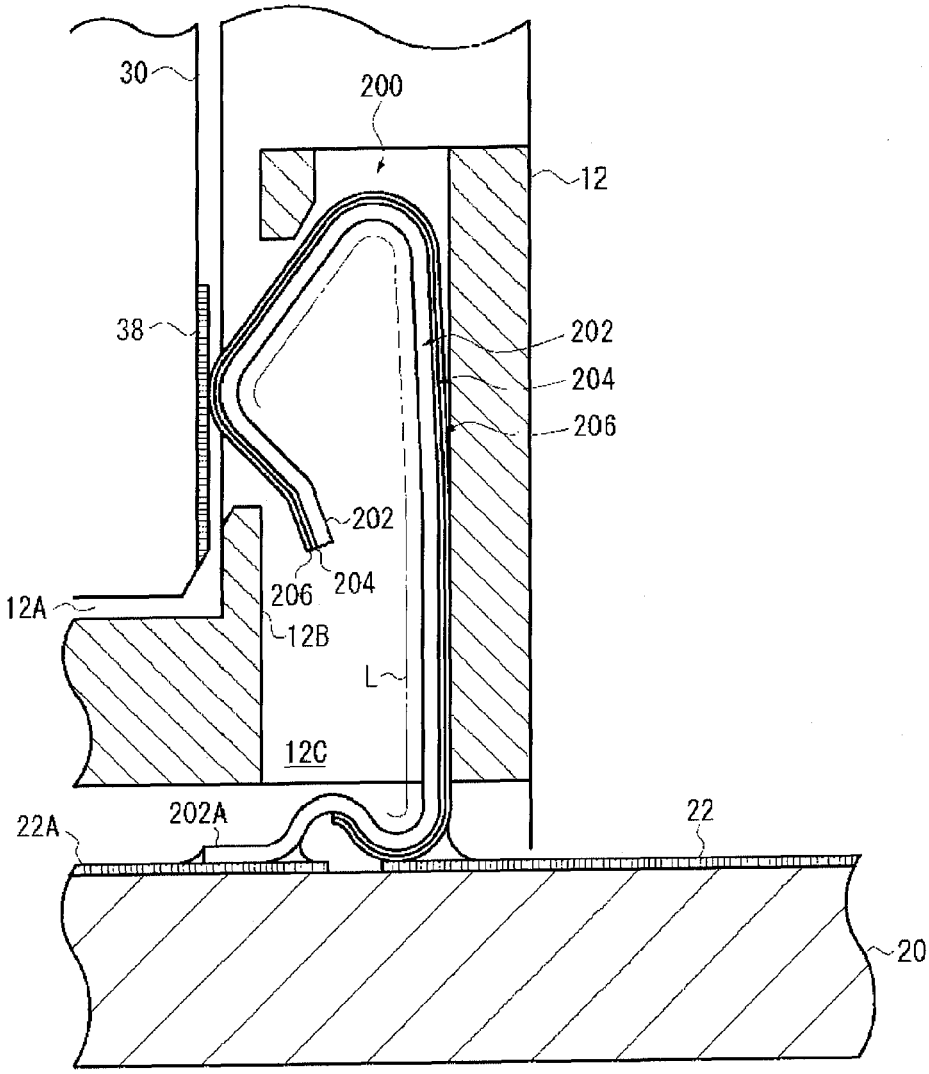
FIG. 6A is a schematic sectional view showing a contact of a socket in accordance with a second embodiment of the present invention.

Next a second embodiment of the present invention is explained. FIG. 6A is a schematic sectional view of a contact of a socket in accordance with the second embodiment of the present invention. In the second embodiment, the contact 200 laminates the resistors and is structured of, for example, three layers. The contact 200 includes a contact body 202 made of a conductive material with electricity such as a cooper or stainless, an electrical protection film 204 of a dielectric material such as polymide film or Teflon (registered trademark) laminated on the contact body 202, and an electrical resistive film 206 of such as nickel chromium, iron chromium or manganese laminated on the electrical protection film 204.

On the motherboard 20, the signal line 22 carrying signal and a ground line 22A supplying a ground potential are formed by the conductive traces and the contact 200 is surface-mounted on the motherboard 20. The contact body 202 is curved beneath the socket body 12 and includes an end portion 202A extending horizontally therefrom. The electrical protection film 204 and the electrical resistive film 206 cover the contact body 202 until the curved portion, that is, both are terminated before the end portion 202A. The end portion 202A of the contact body 202 where the electrical resistive film 206 does not cover is connected to the ground line 22A by soldering and the like, while the electrical resistive film 206 that covers the contact body 202 is connected to the signal line 22 at the curved potion by soldering and the like. On the other hand, in the contact portion of the contact 200, the electrical resistive film 206 is connected to the terminal 38 formed on the substrate of the memory module 30 for making the electrical contact. The contact force between the contact portion and the terminal 38 is generated by the elastic deformation of the bent portion. Thus, by connecting the contact 200 to the ground line and the signal line respectively, a strip line L (showing dashed line) is obtained by itself and thereby providing impedance within the range of the strip line L.

Figure 6B:
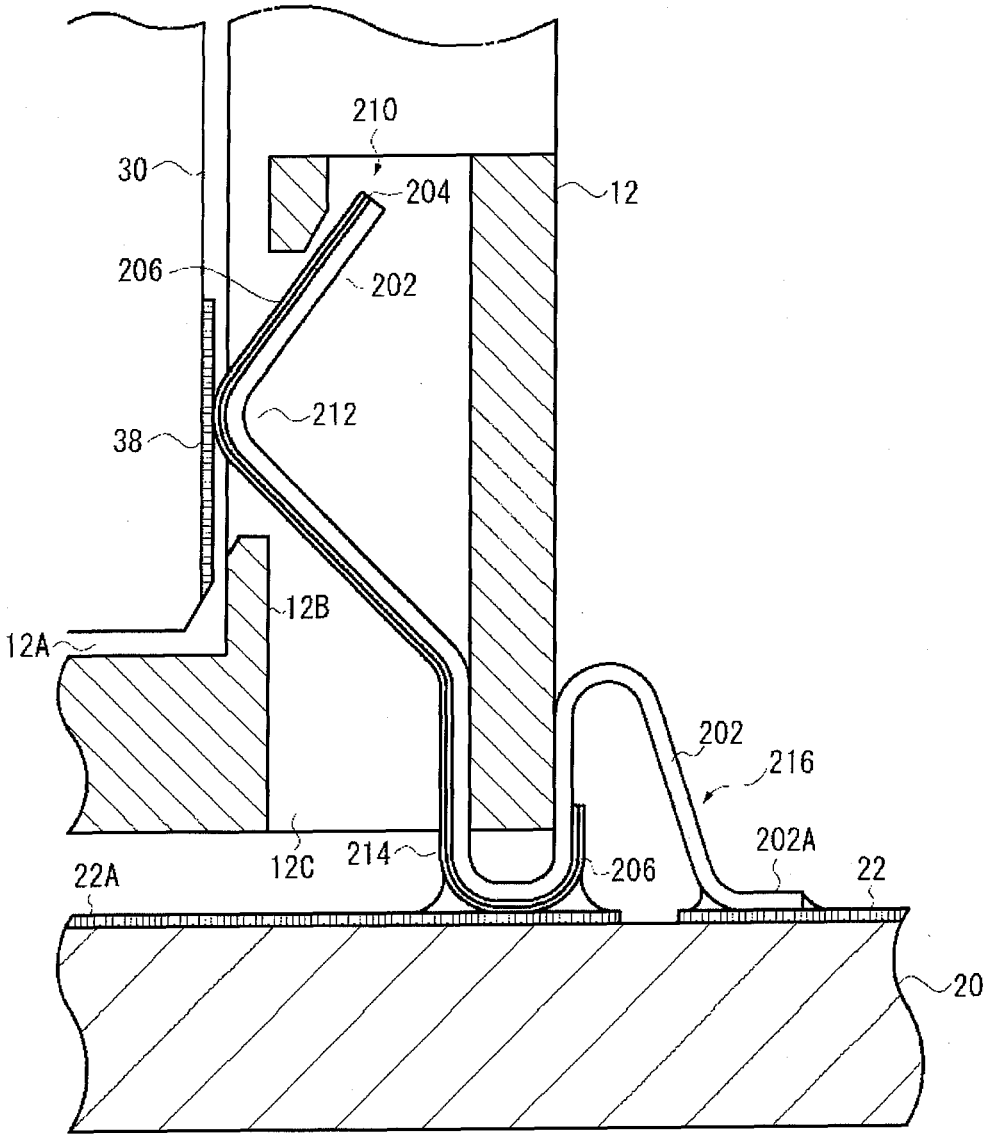
FIG. 6B is a schematic sectional view showing another contact in accordance with the second embodiment of the present invention.

FIG. 6B explains another example of surface-mounting socket in accordance with the second embodiment. In this embodiment, the contact 210 is configured similarly with the above embodiment and has the contact body 202, the electrical protection film 204 and the electrical resistive film 206. A V-shaped contact portion 212 is extended from a bent portion 214 with U shape beneath the socket body 12, a base portion 216 extended from the bent portion 214 is curved as U-shape so that it can surround the sidewall of the socket body 12. The electrical protection film 204 and the electrical resistive film 206 are terminated at the U-shaped bent portion 214, and the contact body 202 is exposed beyond the base portion 216. The electrical resistive film 206 contacts the ground line 22A beneath the bent portion 214 by soldering and the like, and the contact body 202 contacts the signal line 22 separated from the ground line 22A at the flat end 202A of the base portion 216 by soldering and the like.

Figure 6C:
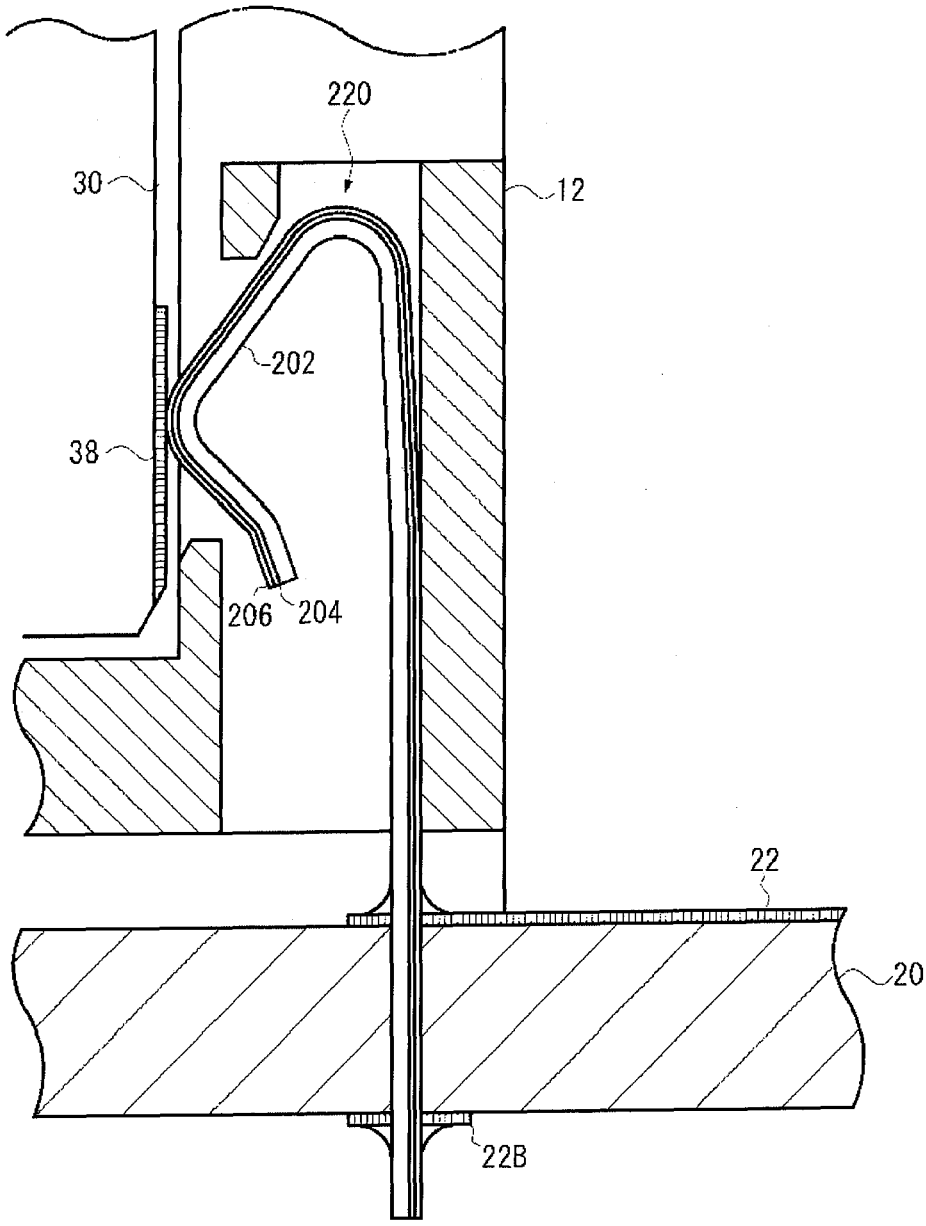
FIG. 6C is a schematic sectional view showing still another contact in accordance with the second embodiment of the present invention.

FIG. 6C explains an example of a socket in accordance with the second embodiment, in which the socket is mounted on the motherboard using the through hole. The signal line 22 is formed on the surface of the motherboard 20, the conductive land 22B is formed on the backside of the motherboard 20, and the through hole between the signal line 22 and the conductive land 22B is formed. The base portion of the contact 220 is extended from the socket body12 downward and is inserted into the through hole. The electrical resistive film 206 is connected to the signal line 22 and the conductive land 22B respectively by soldering and the like. In this case, the contact body 202 may be made of a material with elastic properties for generating the contact force between the terminal 38 and the contact body 202 and it is not necessary to be made of an electrically conductive material.

Figure 6D:
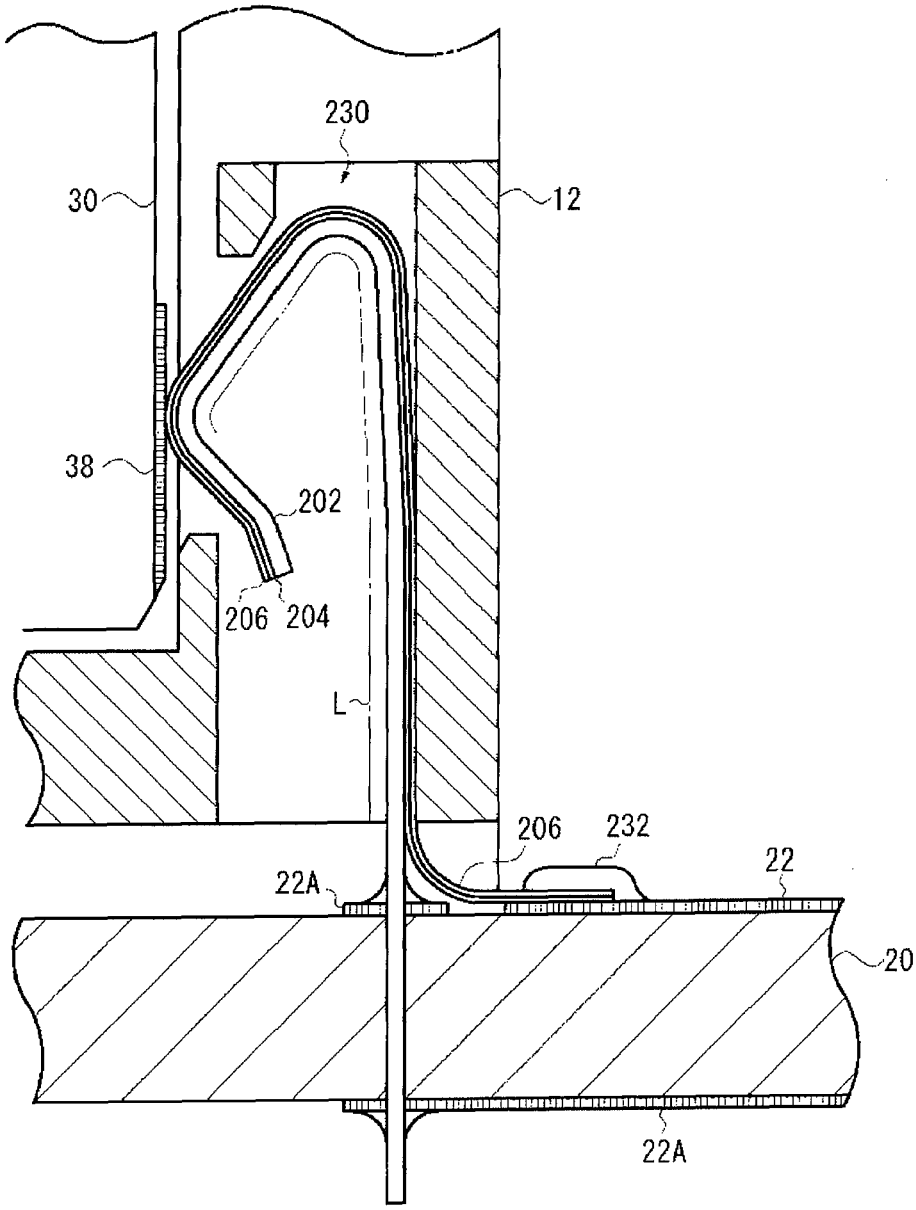
FIG. 6D is a schematic sectional view showing still further another contact in accordance with the second embodiment of the present invention.

FIG. 6D is an improvement of the through hole of FIG. 6C. A contact 230 includes the contact body 202, the electrical protection film 204 and the electrical resistive film 206. The electrical protection film 204 and the electrical resistive film 206 are peeled or removed from the contact body 202 at the base portion. The contact body 202 is inserted into the through hole of the motherboard 20 and is electrically connected to the ground line 22A by soldering and the like. On the other hand, the electrical protection film 204 and the electrical resistive film 206 are extended on the surface of the motherboard 20 and the extended portion is electrically connected to the signal line 22 by soldering 232. Thus, the strip line L (shown in a chain line) is formed in the contact 230 that provides impedance in the range of the strip line L. In this case, the contact body 202 is made of a conductive material with elastic properties.

Figure 7:
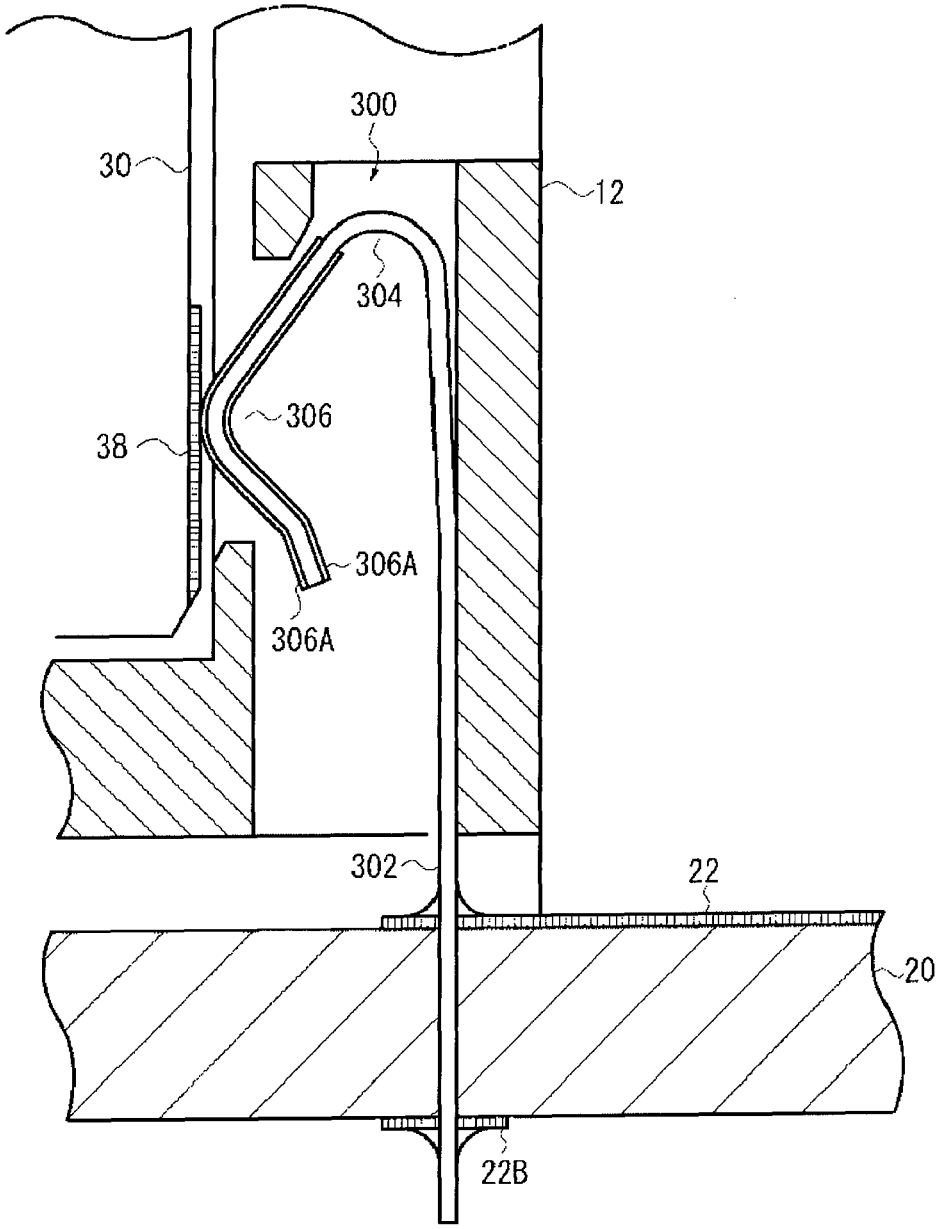
FIG. 7 is a schematic sectional view showing a contact of a socket in accordance with a third embodiment of the present invention.

Next the third embodiment of the present invention is explained. FIG. 7 is a sectional view showing main portion of a socket in accordance with the third embodiment of the present invention. In the third embodiment, a contact 300 is made of a conductive material with elastic properties such as a copper or copper alloy. The contact 300 includes a base portion 302 extending straightly, an bent portion 304 extended from the base portion 302 and being bent as U-shaped and a V-shaped contact portion 304 extended from the bent portion 304. The base portion 302 is extended from the socket body 12 downward and is inserted into the through hole formed on the motherboard 20 to electrically connect with the signal line 22 by soldering and the like. In addition, the base portion 302 may be connected to the conductive land 22B formed on the bottom surface of the motherboard 20 by soldering and the like. Furthermore, the both sides of the contact portion 306 are coated with an electrical resistive film 306A of electrical resistive material. The electrical resistive film 306A is pressed to the terminal 38 of the memory module 30 by the elastic force generated by the bent portion 304 for making electrical contact with the terminal 38. By selecting materials and/or thickness of the electrical resistive film 306A, the function of damping resistor can be added in serial with the path from the signal line 22 to the terminal 38. It is noted that the electrical resistive film 306A may be formed on only one side of the contact portion 306.

Figure 8A:
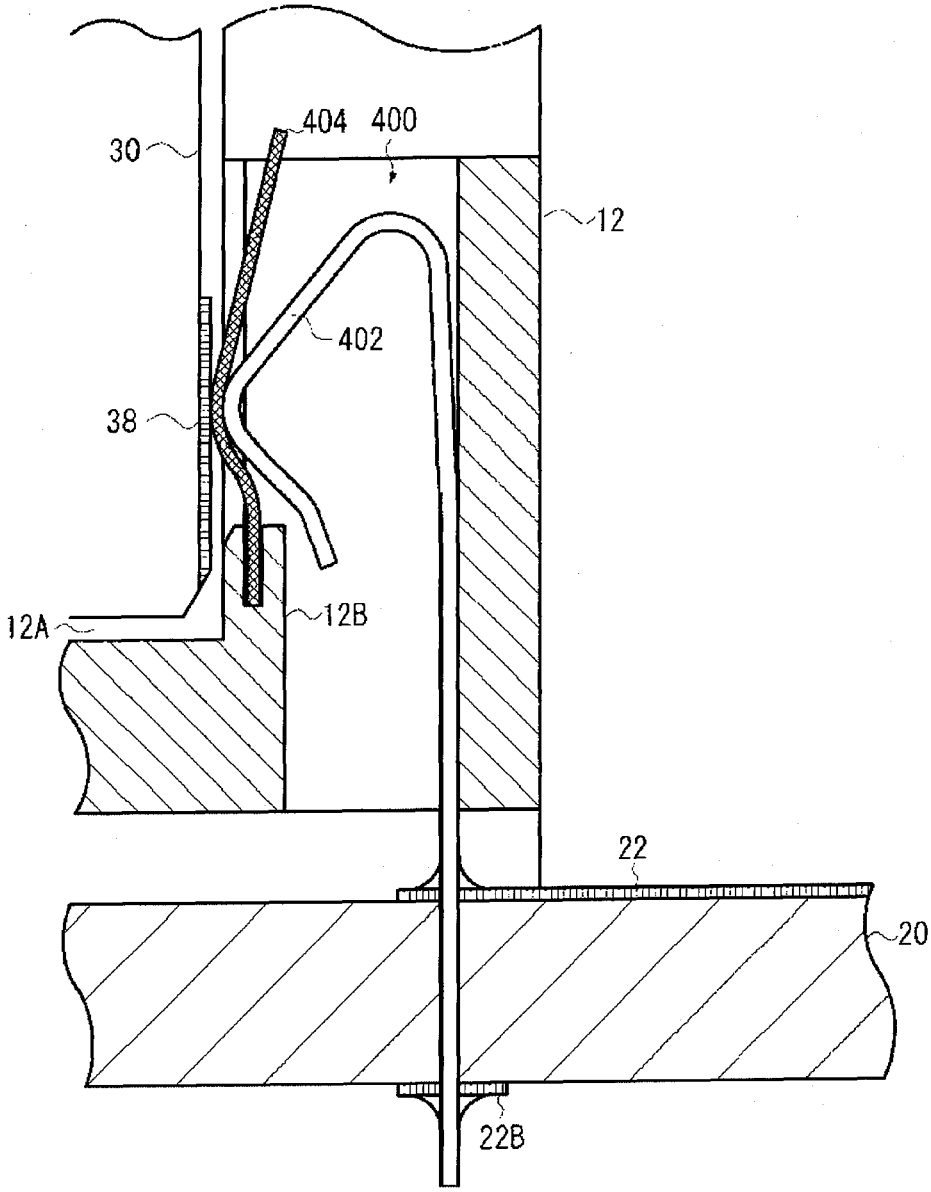
FIG. 8A is a schematic sectional view showing a contact of a socket in accordance with a fourth embodiment of the present invention.

Next the forth embodiment of the present invention is explained. FIG. 8A is a sectional view showing a contact of a socket in accordance with the forth embodiment. A contact 400 of this embodiment includes a contact body 402 and an electrical resistive member 404 using a conductive film as an electrical resistive material. The contact body 402 includes, as well as the above embodiments, the base portion, the U-shaped bent portion extended from the base portion, and the contact portion extended from the bent portion. One end of the resistor 404 of the electrical resistive material is inserted into a groove in a sidewall 12B adjacent to the groove 12A of the socket body 12 so as to be supported as a cantilever. The resistor 404 is connected between the contact portion of the contact body 402 and the terminal 38 of the memory module 30. By selecting material and/or thickness of the electrical resistive material 404, the damping resistor is provided with the current path between the signal line 22 and the terminal 38. The shape and/or size of the electrical resistive member 404 may be appropriately changed according to specifications.

Figure 8B:
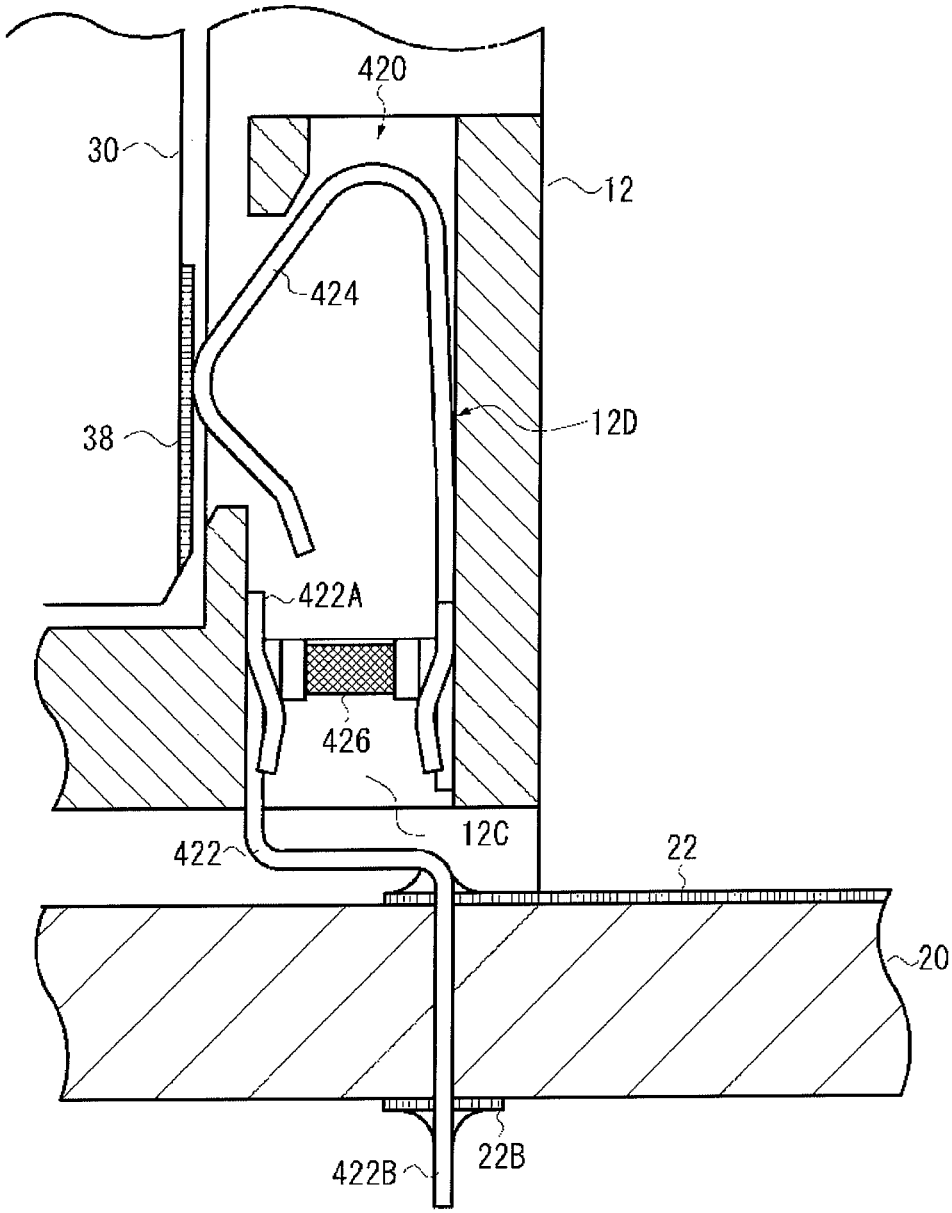
FIG. 8B is a schematic sectional view showing another socket in accordance with the fourth embodiment of the present invention.

FIG. 8B is another example in accordance with the forth embodiment. A contact 420 includes a first contact portion 422, a second contact portion 424 and a resistor 426. The first contact portion 422 includes a first end 422A inserted into an opening 12C of the socket body 12, a bent portion folded from the bottom surface of the socket body 12 as crank shape and a second end 422B extended straightly from the bent portion. The second end 422B is inserted into the through hole of the motherboard 20 to connect with the signal line 22 and/or the conductive land 22B by soldering and the like.

The second contact portion 424 includes a base portion abutted with the side surface 12D of the socket body 12, an U-shaped bent portion extended from the base portion and a contact portion extended from the bent portion. The first end 422A of the first contact portion 422 is formed with a projecting portion for providing elasticity, as well as the base portion of the second contact portion 424 is formed with a projecting portion for providing elasticity. A resistor 426 is pressed into or fitted between the both projecting portions to electrically contact to the first and second contact portions 422, 424. Thus, the current path from the signal line 22 to the memory chip of the memory module 30 through the first contact portion 422, the resistor 426, the second contact portion 424 and the terminal 38 is formed. Please note that the resistor 426 may be made of a material such as conductive films shown in FIG. 8A or conductive ceramic and be soldered with the both ends of the first and second contact portions. According to the present embodiment, the resistor 426 can be changed easily in accordance with each contact pin.

Figure 8C:
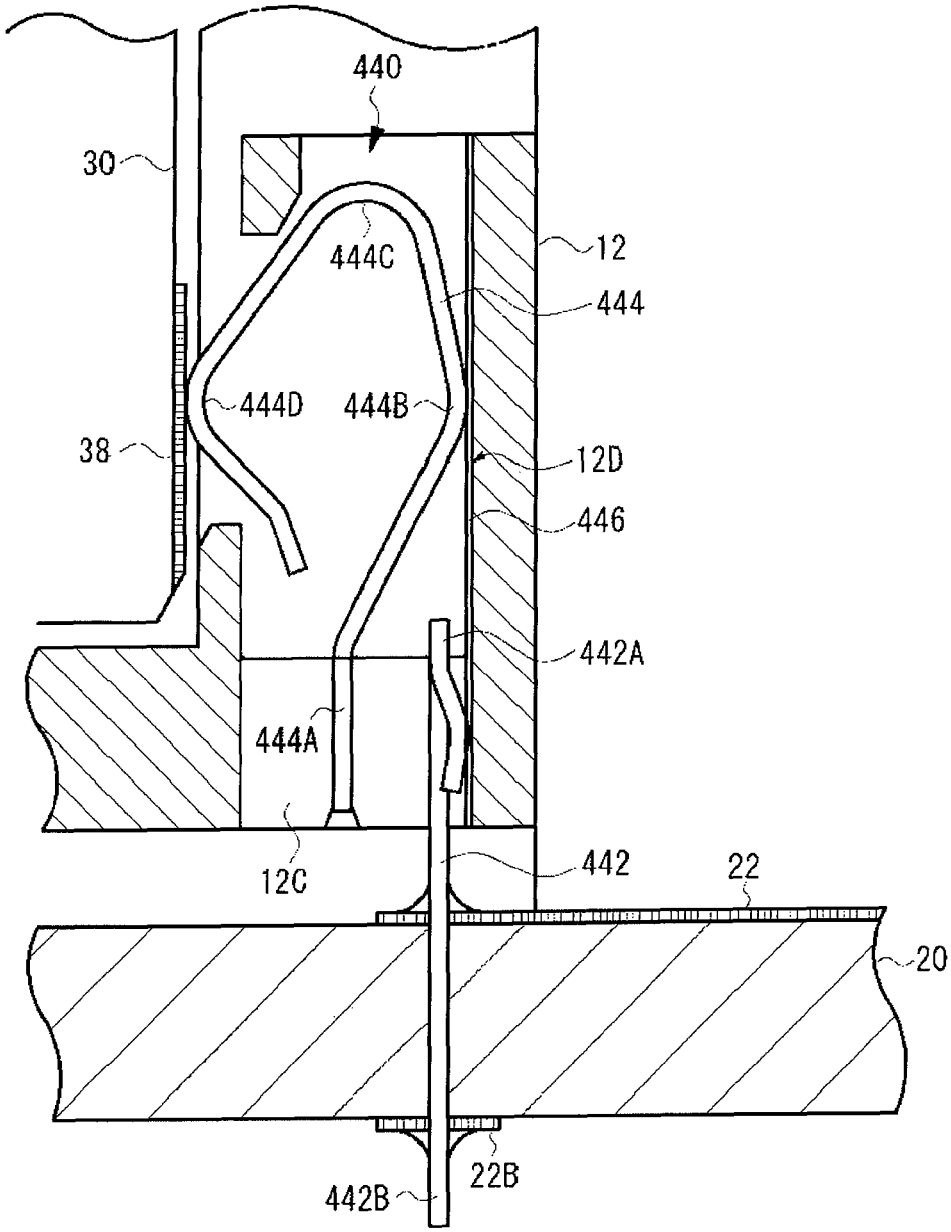
FIG. 8C is a schematic sectional view showing still another socket in accordance with the fourth embodiment of the present invention.

FIG. 8C shows another configuration in accordance with the forth embodiment. A contact 440 includes a first contact portion 442, a second contact portion 444 and a resistor 446. At a side surface 2D facing the opening 12C of the socket body 12, an electrical resistive material such as conductive film is plated, coated or screen-printed to form resistor 446.

The first contact portion 442 includes a first end 442A so as to generate elasticity and the first end 422A contacts the resistor 446. In addition, the first contact portion 442 includes an extended portion that is extended from the opening 12C of the socket body 12 downward and a second end 442B inserted into the through hole of the motherboard 20 to contact with the signal line 22 and/or the conductive land 22B. The second contact portion 444 includes a base portion 444A positioned in the opening 12C, an extended portion 444B that is extended from the base portion 444A diagonally, an U-shaped bent portion 444C bent from the extended portion 444B, and a V-shaped contact portion 444D extended and bent from the bent portion 444C. The bent portion 444C provides elasticity for sandwiching the second contact portion 444 between the resistor 446 and the terminal 38, which causes the extended portion 444B to be electrically connected to the resistor 446 and the contact portion 444D to be electrically connected to the terminal 38 of the memory module 30.

Figure 8D:
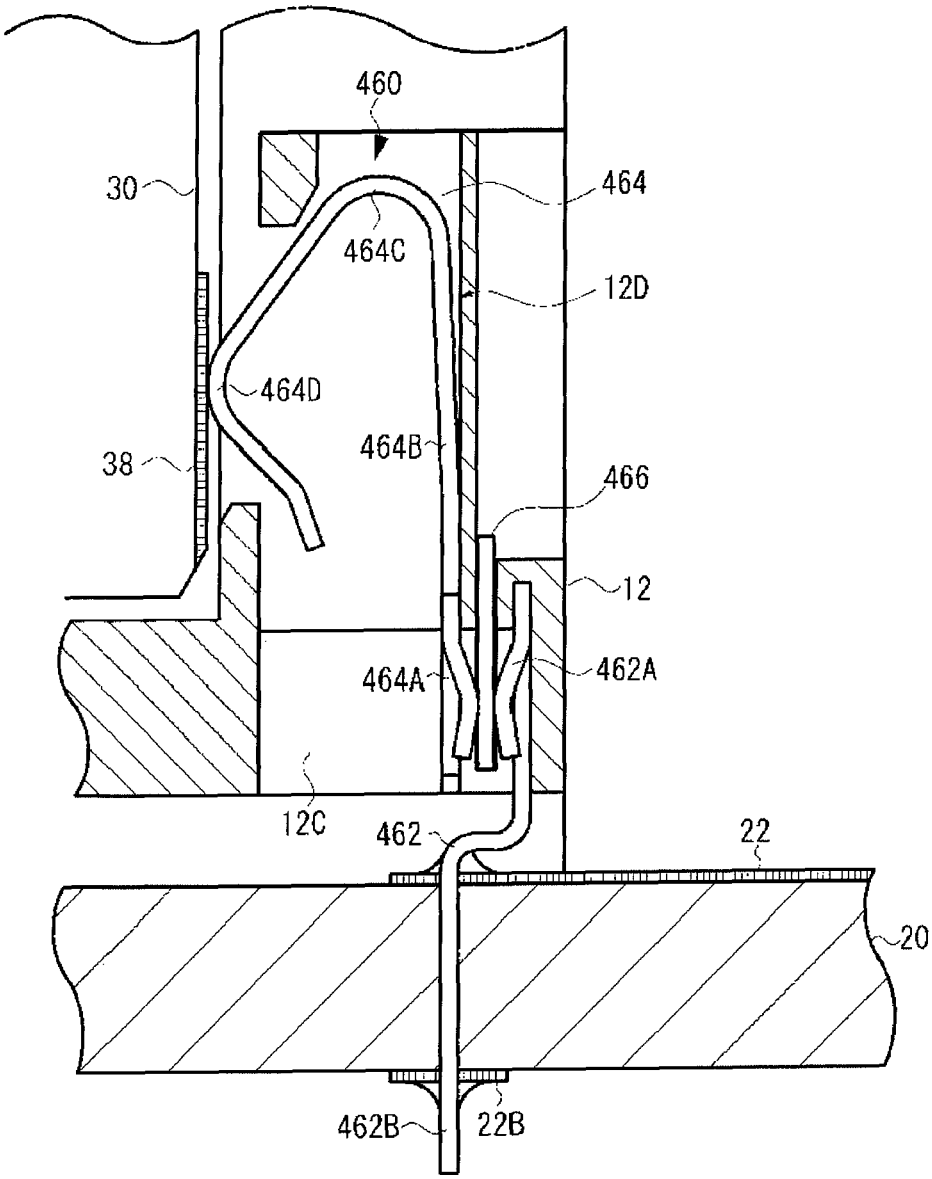
FIG. 8D is a schematic sectional view showing still further another socket in accordance with the fourth embodiment of the present invention.

FIG. 8D shows another configuration in accordance with the forth embodiment. A contact 460 includes a first contact portion 462, a second contact portion 464 and a resistor 466. A first end 462A of the first contact portion 462 is inserted into a hole of the socket body 12 and fixed therein and the second end 462B is inserted into the through hole of the motherboard 20 to electrically connect with the signal line 22 and/or the conductive line 22B.

The second contact portion 464 includes a base portion 464A, an extended portion extended from the base portion 464A straightly, an U-shaped bent portion 464C extended from the extended portion 464B and a V-shaped contact portion 464D connected to the bent portion 464C. The bent portion 464C provides elasticity for sandwiching the second contact portion 464 between the side surface 12D and the terminal 38. In other word, the contact portion 464D is elastically contacted with the terminal 38 and the extended portion 464B is elastically supported by the side surface12D.

The first end 462A of the first contact portion 462 is formed with a projecting portion so as to generate a contact force and the base portion 464A of the second contact portion 464 is formed with a projecting portion so as to generate a contact force. Both projecting portions are opposite and a resistor 466 of an electrically resistive material such as conductive ceramics is connected between the both projecting portions to be elastically supported.

Preferably, the end of resistance 466 is outstood from the socket body 12 which enable it to be inserted or removed. Preferably, the resistance 466 is electrically connected between the base portion 464A and the first end 462A with a constant contact force. According to the present embodiment, the resistor 466 can be changed easily by replacing resistor 466 after the mounting of the contact 460 or the mounting of the socket on the motherboard.

According to the forth embodiment, since the contact is separated into one part that contacts with the memory module and the other part that contacts with the motherboard so as to insert the resistor therebetween, the first contact portion can be made of an elastic material for generating contact force and the second contact portion can be made of different material from the first contact portion because the second contact portion is needed for only material as the electrical conductor. Thus, by providing the predetermined electrical resistance with the contact, the electrical resistive elements (damping resistors) on the motherboard or sub-board are reduced, which enable to downsize the motherboard and memory module system along with the reduction of the number of parts.

Although the invention has been described with regards to specific preferred embodiments thereof, variations and modifications will become apparent to those of ordinary skill in the art. It is therefore, the intent that the appended claims be interpreted as broadly as possible in view of the prior art to include such variations and modifications.

What is claimed:

1. A socket comprising:

a socket body extending at a longitudinal direction;

a plurality of contacts disposed in two lines along the longitudinal direction of the socket body;

wherein when a circuit board, including terminals formed on at least one of opposite surfaces of the circuit board is connected between the two lines of the contacts along with the longitudinal direction of the socket body, each of the terminals is electrically and elastically connected by a corresponding one of the plurality of contacts;

each of the plurality of contacts further comprises:

a contact portion for contacting a corresponding one of the terminals;

an elastic portion extended from the contact portion for generating an elastic force;

an external terminal portion connected to the elastic portion, the contact portion, the elastic portion and the external terminal portion are made of a conductive metal with elastic properties; and a damping resistor comprising an electrical resistive material that is different from the conductive metal, the resistor connected in a current path between the external terminal portion and the corresponding one of the terminals of the circuit board to reduce noise and ringing of carried signals.

2. The socket according to claim 1, wherein the damping resistor engages with an opening formed in the contact portion so as to be projected from the contact portion, wherein the contact portion is capable of electrically connecting with a corresponding terminal of the circuit board through the damping resistor.

3. The socket according to claim 1, wherein the damping resistor includes a conductor and a resistive film, and the conductor is electrically connected to the contact portion through the resistive film.

4. A socket according to claim 1, wherein the resistor includes an electrical protective film laminated on the conductive metal and an electrical resistive film.

5. A socket according to claim 4, wherein the electrical protective film and the electrical resistive film cover the contact portion and a part of the external terminal portion;

the contact portion is electrically connected to each terminal of the circuit board through the electrical resistive film;

the conductive metal of the external terminal portion contacts a reference potential; and the electrical resistive film of the external terminal portion is connected to a signal line.

6. A socket according to claim 1, wherein the resistor includes a resistive film covering the surface of the contact portion.

7. A socket according to claim 1, wherein one end of the resistor is supported by the socket body as a cantilever, and the resistor is connected between the contact portion and the terminals of the circuit board.

8. A socket according to claim 1, wherein the contact includes a first and second contact portions, the first contact portion has the contact portion and the elastic portion, the second contact portion has the external terminal portion, and wherein the resistor is electrically connected between the first and second contact portions.

9. A socket according to claim 8, wherein the first contact portion is made of a conductive metal with elastic properties and the second contact portion is made of a conducive material different from that of the first contact portion.

10. The socket according to claim 1, wherein the circuit board is a memory module that includes a plurality of semiconductor memory chips mounted on a surface of the circuit board.

11. A circuit board system comprising:

a socket;

a circuit board connected to the socket and contacting each contact portion of a plurality of contacts; and another circuit board mounting the socket and contacting each external terminal portions of a plurality of contacts, the socket comprising:

a socket body extending at a longitudinal direction; and the plurality of contacts disposed in two lines along with the longitudinal direction of the socket body;

wherein when the circuit board, including terminals formed on at least one of opposite surfaces of the circuit board is connected between the two lines of the contacts along with the longitudinal direction of the socket body, each of the terminals is electrically and elastically connected by a corresponding one of the contacts;

each of the plurality of contacts further comprises;

a contact portion for contacting a corresponding one of terminals;

an elastic portion extended from the contact portion for generating an elastic force;

an external terminal portion connected to the elastic portion, the contact portion, the elastic portion and the external terminal portion are made of a conductive metal with elastic properties; and a damping resistor comprising an electrical resistive material that is different from the conductive metal, the resistor connected in a current path between the external terminal portion and the corresponding one of the terminals of the circuit board to reduce noise and ringing of carried signals.

12. The circuit board system according to claim 11, wherein the another circuit board includes a main surface on which a signal line and a reference potential line spaced from the signal line are formed, the conductive metal of the external terminal portion is connected to the reference potential line, and an electrical resistive film of the external terminal portion is connected to the signal line.

13. The circuit board system according to claim 11, wherein the another circuit board includes through-holes and the external terminal portions are inserted into corresponding through-holes to electrically connect to the signal line.

* * * * *